US008839865B2

(12) United States Patent
Willberg et al.

(10) Patent No.: US 8,839,865 B2
(45) Date of Patent: Sep. 23, 2014

(54) SLIP-LAYER FLUID PLACEMENT

(75) Inventors: Dean Willberg, Tucson, AZ (US); Kseniya Evgenievna Eliseeva, Berdsk (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 634 days.

(21) Appl. No.: 12/866,507

(22) PCT Filed: Feb. 27, 2008

(86) PCT No.: PCT/RU2008/000108

§ 371 (c)(1), (2), (4) Date: Oct. 26, 2010

(87) PCT Pub. No.: WO2009/113896

PCT Pub. Date: Sep. 17, 2009

(65) Prior Publication Data

US 2011/0036583 A1 Feb. 17, 2011

(51) Int. Cl.
*E21B 43/26* (2006.01)
*E21B 43/267* (2006.01)

(52) U.S. Cl.
CPC ..... *E21B 43/26* (2013.01); *E21B 43/267* (2013.01)
USPC ..... 166/300; 166/305.1; 166/308.1

(58) Field of Classification Search
None
See application file for complete search history.

(56) References Cited

U.S. PATENT DOCUMENTS 3,952,741 A 4/1976 Baker
3,983,254 A 9/1976 Alterman et al.
4,078,609 A * 3/1978 Pavlich ..... 166/271
4,506,734 A * 3/1985 Nolte ..... 166/308.1
4,548,847 A 10/1985 Aberson
4,658,861 A 4/1987 Roberson
4,670,166 A 6/1987 McDougall et al.
4,713,251 A 12/1987 Seighman
4,725,628 A 2/1988 Garvey et al.
4,741,401 A 5/1988 Walles et al.
4,770,796 A 9/1988 Jacobs
4,772,477 A 9/1988 Weiss et al.
4,848,467 A 7/1989 Cantu et al.

(Continued)

FOREIGN PATENT DOCUMENTS

WO 2007/086771 8/2007

OTHER PUBLICATIONS

Mukherjee, H., Paoli, B. F., McDonald, T., Cartaya, H., Anderson, J. A.: "Successful Control of Fracture Height Growth by Placement of Artificial Barrier", SPE 25917, May 1995.

(Continued)

*Primary Examiner* — Angela M DiTrani
(74) *Attorney, Agent, or Firm* — Jeremy D. Tillman; Rachel Greene; Tim Curington

(57) ABSTRACT

A method of fluid placement in a hydraulic fracture created in a subterranean formation penetrated by a wellbore that comprises the use of one or more reactants that form a low friction layer between the fluids that penetrate the fracture in consecutive treatment stages. Reactants can be added to the fluid that is the carrier or other fluid to be placed in a specific region of the fracture, namely as an upper or lower boundary of the fracture, or added to both the stage that requires placement in a specific section of the fracture and in the stage preceding it, especially the pad and carrier fluids used in consecutive stages.

24 Claims, 4 Drawing Sheets

(56) References Cited

U.S. PATENT DOCUMENTS

| | | | | | |
|---|---|---|---|---|---|
| 4,933,190 | A | | 6/1990 | Cherukuri et al. | |
| 4,957,165 | A | | 9/1990 | Cantu et al. | |
| 4,978,537 | A | | 12/1990 | Song | |
| 4,986,355 | A | | 1/1991 | Casad et al. | |
| 5,018,578 | A | * | 5/1991 | El Rabaa et al. | 166/281 |
| 5,103,905 | A | | 4/1992 | Brannon | |
| 5,110,486 | A | | 5/1992 | Manalastas et al. | |
| 5,164,099 | A | | 11/1992 | Gupta et al. | |
| 5,271,466 | A | * | 12/1993 | Harms | 166/300 |
| 5,373,901 | A | | 12/1994 | Norman et al. | |
| 5,411,091 | A | | 5/1995 | Jennings | |
| 5,425,421 | A | | 6/1995 | Coleman et al. | |
| 5,505,740 | A | | 4/1996 | Kong et al. | |
| 5,551,516 | A | | 9/1996 | Norman et al. | |
| 5,558,161 | A | * | 9/1996 | Vitthal et al. | 166/280.1 |
| 5,667,012 | A | | 9/1997 | Hoover et al. | |
| 5,669,447 | A | * | 9/1997 | Walker et al. | 166/300 |
| 5,716,923 | A | | 2/1998 | MacBeath | |
| 5,910,322 | A | | 6/1999 | Rivett et al. | |
| 5,948,735 | A | | 9/1999 | Newlove et al. | |
| 5,964,295 | A | | 10/1999 | Brown et al. | |
| 5,979,555 | A | | 11/1999 | Gadberry et al. | |
| 5,979,557 | A | | 11/1999 | Card et al. | |
| 6,060,436 | A | * | 5/2000 | Snyder et al. | 507/266 |
| 6,063,738 | A | * | 5/2000 | Chatterji et al. | 507/269 |
| 6,140,277 | A | | 10/2000 | Tibbles et al. | |
| 6,258,859 | B1 | | 7/2001 | Dahayanake et al. | |
| 6,509,301 | B1 | | 1/2003 | Vollmer | |
| 6,841,229 | B2 | | 1/2005 | Sun et al. | |
| 7,004,255 | B2 | | 2/2006 | Boney | |
| 7,036,590 | B2 | * | 5/2006 | Harris | 166/280.1 |
| 7,207,396 | B2 | | 4/2007 | Hall et al. | |
| 7,213,651 | B2 | | 5/2007 | Brannon et al. | |
| 2002/0039869 | A1 | | 4/2002 | Achille | |
| 2003/0106690 | A1 | | 6/2003 | Boney et al. | |
| 2004/0200617 | A1 | | 10/2004 | Stephenson et al. | |
| 2004/0244978 | A1 | * | 12/2004 | Shaarpour | 166/293 |
| 2005/0016732 | A1 | | 1/2005 | Brannon | |
| 2005/0274523 | A1 | * | 12/2005 | Brannon et al. | 166/308.3 |
| 2006/0086501 | A1 | | 4/2006 | Creel et al. | |
| 2008/0108524 | A1 | | 5/2008 | Willberg et al. | |

OTHER PUBLICATIONS

Examiner's Report for the equivalent Canadian patent application No. 2716186 issued on Apr. 30, 2013.

* cited by examiner

SLIP-LAYER FLUID PLACEMENT

BACKGROUND

This invention relates to the placement of fluids in subterranean formations of oil and gas wells, and particularly to the placement of fluids in connection with hydraulic fracturing.

In subterranean formations of oil and gas wells, stress barriers can be insufficient to contain hydraulic fractures made within the producing zone. This can lead to inefficient fracturing, with much of the treatment potentially stimulating non-productive zones. Vertical fracture growth out of the hydrocarbon bearing portions of the formation, either up or down, may result from hydraulic fracturing in such formations having little or no stress contrast between the formation layers. A particular problem is the unwanted fracturing or stimulation of water or undesirable gas producing zones.

Containment of these undesirable fractures has been accomplished by placing an artificial barrier along the boundaries of the fracture to prevent further fracture growth out of the producing zone. Containment of fracture growth has been attempted by placing proppants and fluids with different densities in the fracture. These techniques are unreliable due to the difficulty of providing proper barrier placement.

SPE 25917 suggests control of fracture height growth through the selective placement of artificial barriers above and below the pay zone. These barriers are created prior to the actual treatment by pumping low viscosity carrying fluid with a mix of different size and density proppants that settle to the bottom and/or float to the top of the fracture channel or both. Typically a viscous pad is pumped to create a fracture channel, followed with a 5-10 mPa-s fluid slurry carrying a mix of heavier proppant that settles to the bottom of the fracture channel and a light proppant that rises to the top of the fracture channel. The proppant bridges at the top and/or bottom of the fracture can block vertical fracture growth. However, the accurate placement of two kinds of proppant through control of density and viscosity of one carrier fluid can be a challenging task.

Selective treatment of fracture zones is known. For example, U.S. Pat. No. 5,425,421 injects a settable gel composition, such as a polyacrylamide polymer cross-linked with inorganic transition metals, into the portion of the fracture extending within a water-producing zone. Placement of two or more different fluids into a forming fracture had been reported before, although for purposes other than selectively treating fracture zones. For example, U.S. Pat. No. 5,411,091 describes a method for enhanced hydraulic fracturing, which involves injecting a proppant-laden fracturing fluid, then a low-viscosity spacer fluid, and then a proppant-laden fracturing fluid at a sufficient rate and pressure to hold the created fracture open. This allows proppant to be more evenly distributed throughout as it falls through the spacer fluid, thereby claiming to avoid proppant convection in the fracture while obtaining substantially improved propping of the fracture.

The use of particles in fluids of different densities for proper placement and prevention of undesirable fracture growth into the bare rock zones is disclosed in U.S. Pat. No. 7,207,396. After pumping a proppant-free pad, lightweight proppant-laden slurry is introduced into the formation. Either the fluid density of the pad fluid is greater than the fluid density of the proppant-laden slurry, or the viscosity of the pad fluid is greater than the viscosity of the proppant-laden slurry.

U.S. Pat. No. 7,213,651 describes injecting a first fracturing fluid into a formation, followed by a second fracturing fluid, to create extended conductive channels through a formation. The fracturing fluids can be different in density, viscosity, pH and the other related characteristics to allow for variations in the conductive channels formed. Proppants can also be included in one or both of the injected fluids. The method attempts to enhance fracture conductivity while minimizing proppant flowback typically associated with hydraulic fracturing techniques.

It is thus seen in the prior art that combinations of two or more fluids are introduced into a subterranean formation for different purposes that may include altering formation permeability, proppant placement control, flowback prevention, etc. However, in practice such methods have difficulty to achieve prompt and accurate placement of fluids with special functions and/or laden with special materials into a designated segment of the fracture. In particular, the mobility of specialized fluids inside the fracture may be restricted by high shear stresses developed at the interface of the specialized fluid with other treatment fluids when the viscosities of the contacting fluids are both relatively high.

SUMMARY

This invention relates in one embodiment to chemical enhancement of fluid placement in a hydraulic fracture created in a subterranean formation. Treating a formation penetrated by a wellbore in an embodiment can include pumping a pad stage viscosified with a linear polymer, crosslinked polymer or a viscoelastic surfactant system (VES) or the like; and pumping a slurry of particles as a discrete stage into the wellbore of the formation that provides delayed water-swelling, bridging, leak-off control or other materials. Thereafter, the fracturing treatment can include additional pad and/or proppant containing stages.

The fluid in the discrete stage in one embodiment of this invention can be pumped down the wellbore during or after the initial stage of the treatment (pad) with the aim to deliver and distribute materials along either or both of the fracture lower and upper boundaries that can arrest vertical growth of the fracture and/or create a water impermeable barrier. For placement on the lower fracture boundary, the discrete carrier stage can have a density higher than the previously placed or main fracturing fluid used in the earlier pad and subsequent proppant laden stages, which would ensure gravitational slumping of the carrier fluid to the lower portion of the fracture and along its lower boundary. Conversely, in another embodiment, to deliver and distribute material of a desirable function along the upper fracture extremity, the carrier fluid can be lighter in density and include buoyant particulate materials such as polymer particles, hollow beads, porous particles, fibers, foaming agents, or the like.

A feature of the methods described in the various embodiments of this invention can enhance slumping or surfacing of the carrier fluid by creation of a relatively thin layer of low friction between the main fracturing fluid and the carrier fluid. Such a layer can be formed by drastically lowering viscosity on the boundary or interface of the two fluids, which can be accomplished in an embodiment by chemical breaking of the fracturing gel at the interface. For example, in one embodiment, the carrier fluid and the main fracturing fluid can both have viscosity above 35 mPa-s at 100 $sec^{-1}$ and at the temperature of contact, while the slip layer can have a viscosity less than 15 mPa-s at the same conditions. The process in an embodiment can take place instantaneously upon contact of the two fluids and can be initiated and accelerated by chemicals contained in one fluid or both fluids at the interface. In various embodiments of this invention, the reactive chemicals may be inorganic acids, such as hydrochloric, phosphoric, sulfuric etc. and organic acids, such as formic, acetic, oxalic etc., contained in the carrier fluid, and brought in contact with a guar-based fracturing gel or other gelling agent in which acids cause quick polymer chain fragmentation and a rapid loss of viscosity. Another embodiment involves adding chemical breakers, for example salts of peroxydisulfuric acid, to the carrier fluid, and adding a breaker aid, for example catalysts such as triethanolamine, transition metal salts, metallic particles and the like, to the fracturing gel that would activate the breaker upon mixing with the breaker in a fluid boundary region to destroy guar polymer in a thin layer.

One embodiment of the invention accordingly provides a method of treating a formation penetrated by a wellbore. The method can include introducing a first fluid comprising a first gelling agent into the formation; and introducing a second fluid comprising a second gelling agent into the formation in contact with the first fluid at an interface between the first and second fluids, wherein the first and second gelling agents can be the same or different. The first and second fluids can be chemically reactive to create a slip layer of lowered viscosity relative to the first and second fluids at the interface to facilitate penetration of the second fluid through the first fluid.

In an embodiment, the first fluid introduction can include injection of a pad fluid in a fracturing treatment. The second fluid introduction can include injection of a carrier fluid comprising a solids-laden slurry in the fracturing treatment. The slurry in one embodiment can include particles selected from delayed water-swelling particles, bridging materials, leak-off control materials and the like, and combinations thereof. In a preferred embodiment, the slurry can comprise a water absorbing composition comprising a particle having a core of a water-swelling material and a coating substantially surrounding the core that temporarily prevents contact of water with the water-swelling material, the coating being formed from at least one of (1) a layer or layers of water degradable material and (2) a non-water-degradable, non-water absorbent layer or layers of encapsulating material.

In an embodiment, the pad and carrier gelling agents can be selected from linear polymers, crosslinked polymers and viscoelastic surfactant systems. The first and second fluids can, for example, have a viscosity during the introductions of at least 35 mPa-s, preferably at least 50 mPa-s, and the slip layer can have a viscosity less than 15 mPa-s, preferably less than 10 mPa-s. In an embodiment, the first and second fluids can have different specific gravities.

In a particular embodiment, the slip layer can be formed by the reaction of at least one reactant from the pad fluid and at least one reactant from the carrier fluid. The reactants can include, for example, a viscosity breaker for at least one of the pad or carrier gelling agents in at least one of the pad or carrier fluids. In one embodiment, at least one of the pad or carrier gelling agents can be selected from linear and crosslinked polysaccharides and the breaker can be selected from mineral and organic acids and their precursors. If desired, the polysaccharide gelling agent can be present in the pad fluid and the breaker can be present in the carrier fluid. The carrier fluid can have an acidic pH and a carrier gelling agent comprising amine polymer hydrated at the pH of the carrier fluid. The pad stage can also include an activatable breaker selected from breakers activated by acidic conditions, in one embodiment an oxyhalogen acid salt such as a bromate, iodate, chlorate or hypochlorite salt of an alkali metal. Some of the oxyhalogen acid salts provided in the pad stage can additionally or alternatively be catalyzed by transition metals salts or colloidal metal particles provided in the carrier fluid.

In one embodiment, the pad and carrier fluids can each include a gelling agent selected from linear and crosslinked polysaccharides wherein the pad fluid gelling agent and the carrier fluid gelling agent can be the same or different, wherein the viscosity breaker can be present in one of the pad and carrier fluids, and a breaker aid can be present in the other of the pad and the carrier fluids. For example, the breaker can include an ammonium or alkali metal salt of peroxydisulfuric acid and the breaker aid can be selected from amines, aliphatic amine derivatives and the like, and mixtures thereof.

In another embodiment, at least one of the pad or carrier gelling agents can include borate crosslinked polysaccharide and the other of the pad or carrier fluid can include a hydrated amine polymer. In an embodiment, the hydrated amine polymer-gelled fluid can include a borate-ion-complexing agent, such as a polyol, wherein the slip layer is created by depleting borate availability at a boundary of the borate-crosslinked fluid.

In one preferred embodiment, a method of fracturing a formation penetrated by a wellbore includes: (1) injecting a pad fluid comprising a pad gelling agent into the formation; (2) injecting a carrier fluid comprising a particle-laden slurry comprising a carrier gelling agent into the formation in contact with the pad fluid at an interface between the pad and carrier fluids, wherein the pad and carrier gelling agents can be the same or different and are selected from linear polymers, crosslinked polymers and viscoelastic surfactant systems; and (3) wherein the pad and carrier fluids are chemically reactive to create a slip layer of lowered viscosity relative to the pad and carrier fluids at the interface to facilitate penetration of the carrier fluid through the pad fluid, wherein at least one of the pad and carrier fluids comprise a viscosity breaker for at least one of the pad or carrier gelling agents.

In a further embodiment, the pad fluid can be heavier than the carrier fluid and the proppant can be buoyant. Alternatively or additionally, the method can include a pad stage wherein the pad fluid is lighter than the carrier fluid and the proppant is negatively buoyant.

DETAILED DESCRIPTION

The present invention is related to a reliable delivery mechanism for the materials designed to effectively mitigate fracture vertical growth, or alternatively or additionally to block water production, all without seriously compromising fracture conductivity. In an embodiment, particles with barrier forming or water control functions known in the art can be quantitatively delivered and precisely placed along lower and/or upper fracture extremity during a certain stage of the treatment.

To meet the stringent requirements of this application of the invention, a carrier fluid used as a vehicle for delivery and placement in one embodiment should satisfy one or more of the following criteria: (1) the carrier fluid can be distinct from the pad fluid and can destabilize the latter at the phase boundary; (2) the carrier fluid can be chemically distinct from the pad fluid and contain a breaker, pH adjusting agent or a complexing agent that destabilizes the pad fluid at the interface; (3) the carrier fluid can be of the same or similar composition as the pad fluid, but one of the fluids can contain a breaker while the other can contain an activator which, upon contact at the interface, can trigger a viscosity breaking action at the boundary between the fluids; (4) the carrier fluid can suspend solid particles such as weighing agents as well as particulates for other functions for the period of time sufficient for placement of the slurry in a desired portion of the fracture; and/or (5) the carrier fluid can tolerate the additives that chemically degrade the guar-based polymers or other viscosifying agent of the pad fluid. Further, in an embodiment, components added to or otherwise present in the separate stages of the treatment, i.e. the pad and the following barrier forming stage, are desirably tolerant to other components in the fracturing method, e.g. in the pad and carrier stages as well as other stages pumped either before or more commonly thereafter.

Figure 1:
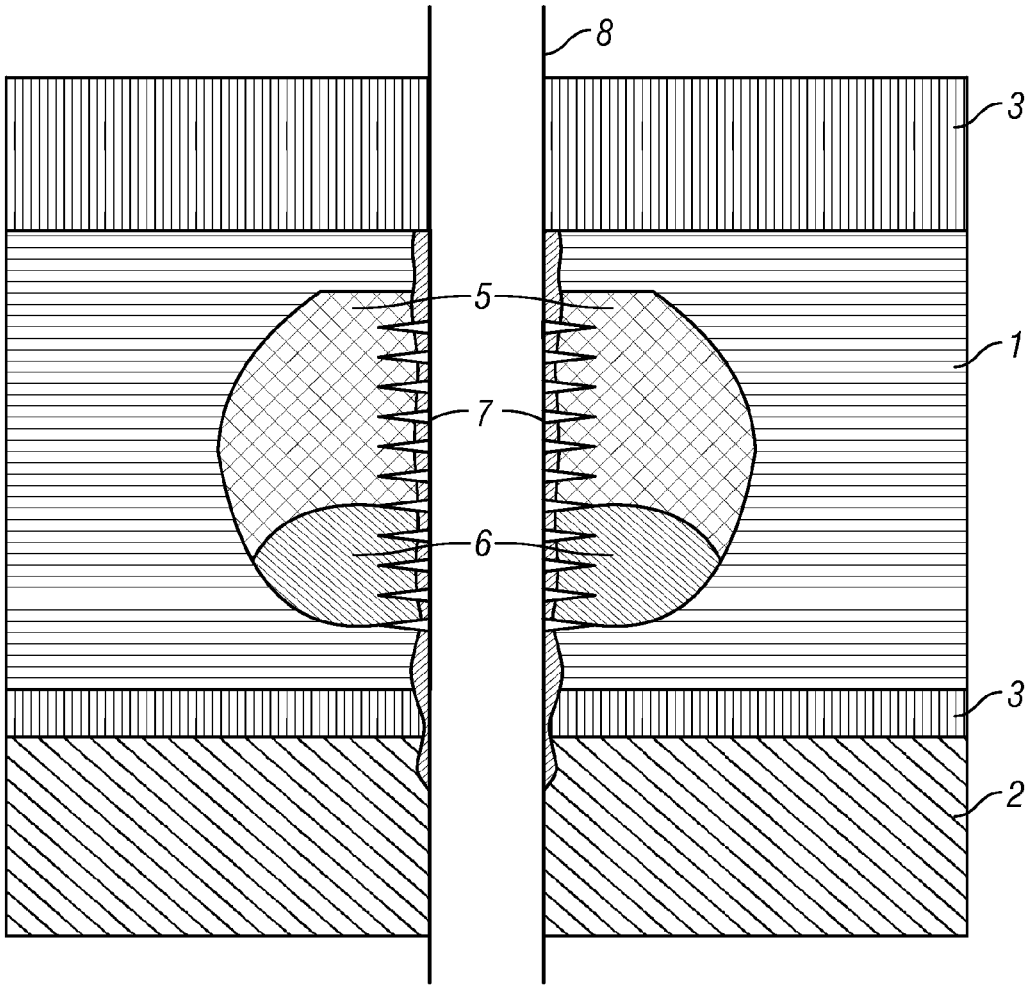
FIG. 1 is a schematic depiction of fluid placement in an early stage of fracturing according to an embodiment of the invention.
Figure 2:
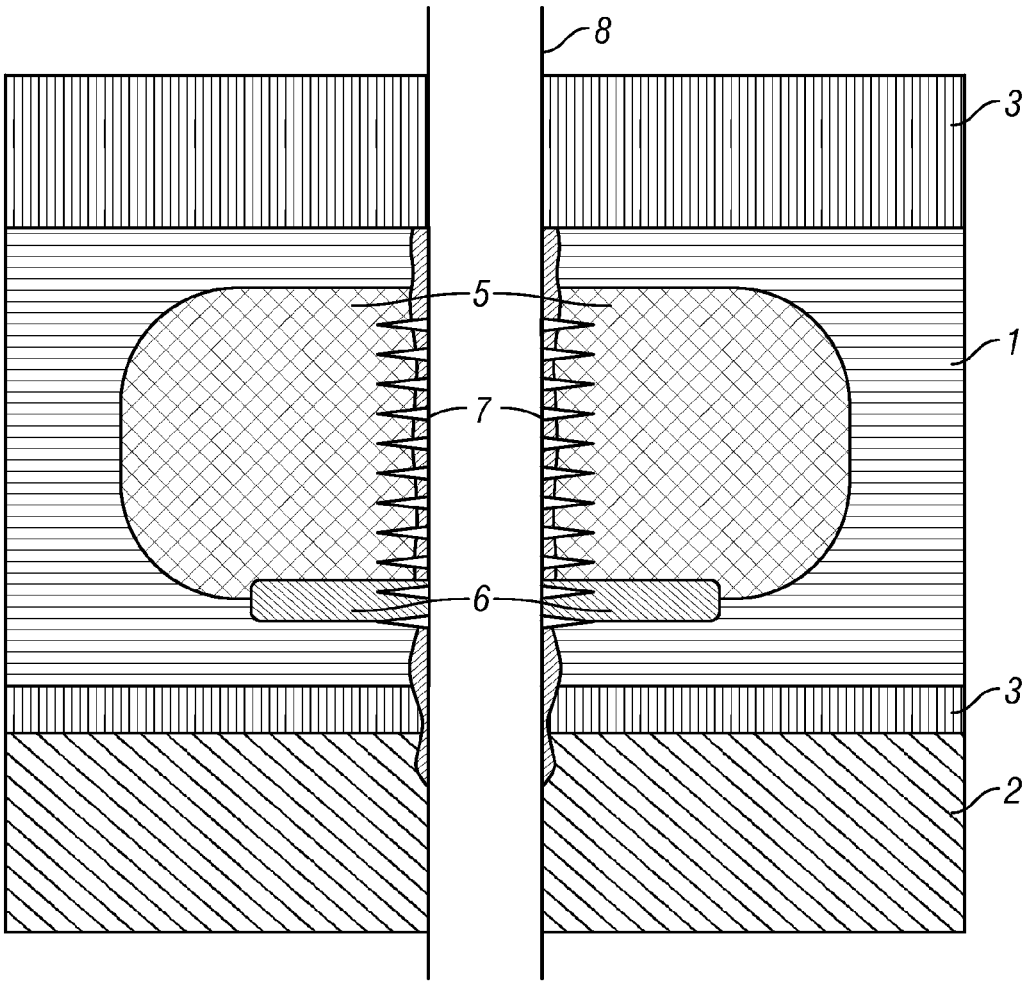
FIG. 2 is a schematic depiction of fluid placement in a later stage of the fracturing of FIG. 1 according to an embodiment of the invention.

FIG. 1 illustrates the initial stage of fracture growth within the pay zone 1 separated from the water zone 2 by the adjacent strata 3. The upper fluid 5 is responsible for steady growth of fracture as a result of a conventional fracturing technique. The lower fluid 6 is a heavy gel or carrier fluid pumped for performing specific operations in the bottom part of the fracture. Both fluids 5 and 6 are injected through a series of perforations 7 via the wellbore 8. In the prior art, the high-viscosity heavy fluid 6 penetrates slowly to the destination due to fluid-fluid interaction, whereas according to the present invention the creation of a slip layer facilitates a relatively rapid deployment of the fluid 6. In FIG. 2, where like numerals are used for like components, the final result of the fracture development and placement of carrier fluid are schematically shown. The carrier fluid (heavy gel) 6 has reached the destination location to deliver the water-controlling agent or other working additives.

The carrier fluid may be any fluid having properties that allow the particulate materials to be transported therein. It can be the same fluid as that employed as the pad and/or the main fracturing fluid. Examples of suitable carrier fluids may include water, oil, viscosified water (such as water based guar, modified guar gel crosslinked with borate or organometallic compounds, or water viscosified with a viscoelastic surfactant that forms micelles), viscosified oil, emulsions, and energized fluids (for example with nitrogen or $CO_2$ gas). In certain applications, other materials may be present in the carrier fluid, which can include such materials as xanthan gum, whelan gum, scleroglucan, etc., as viscosifiers, as well as bentonite in aqueous solutions. If a non-aqueous carrier fluid is used, viscosifiers may include organophilic clays and phosphate esters.

The aqueous pad, carrier fluid and other treatment fluids can be viscosified with a polymer based fluid (such as a polysaccharide, such as guar or a guar derivative, linear or crosslinked, or a polyacrylamide, etc.); or a surfactant based fluid (such as by example a viscoelastic surfactant based fluid system (VES). Typical polymers used in the oil and gas industry can include polysaccharides such as starch, galactomannans such as guar, derivatized guars such as hydroxypropyl guar, carboxymethyl guar, carboxymethyl-hydroxypropyl guar, hydrophobically modified galactomannans, xanthan gum, hydroxyethylcellulose, and polymers, copolymers and terpolymers containing acrylamide monomer, and the like. The polymers can also be crosslinked with, for example, metal ions such as borate, zirconium or titanium including complexed metals, and so on.

Other embodiments of polymeric viscosifiers include polyvinyl polymers, polymethacrylamides, cellulose ethers, lignosulfonates, and ammonium, alkali metal, and alkaline earth salts thereof. More specific examples of these typical water soluble polymers are amine polymers, such as acrylic acid-acrylamide copolymers, acrylic acid-methacrylamide copolymers, polyacrylamides, partially hydrolyzed polyacrylamides, partially hydrolyzed polymethacrylamides, and other anionic or cationic polyacrylamide copolymers; polyvinyl alcohol; polyvinyl acetate; polyalkyleneoxides; carboxycelluloses; carboxyalkylhydroxyethyl celluloses; hydroxyethylcellulose; other galactomannans; heteropolysaccharides obtained by the fermentation of starch-derived sugar (e.g., xanthan gum); and ammonium and alkali metal salts thereof. Cellulose derivatives can also be used in an embodiment, such as hydroxyethylcellulose (HEC) or hydroxypropylcellulose (HPC), carboxymethylhydroxyethylcellulose (CMHEC) and carboxymethycellulose (CMC), with or without crosslinkers. Xanthan, diutan, and scleroglucan, three biopolymers, have been shown to have excellent proppant-suspension ability even though they are more expensive than guar derivatives and therefore have been used less frequently unless they can be used at lower concentrations.

Linear (not cross-linked) polymer systems can be used in another embodiment, but generally require more polymer for the same level of viscosification.

All crosslinked polymer systems may be used, including for example delayed, optimized for high temperature, optimized for use with sea water, buffered at various pH's, and optimized for low temperature. Any crosslinker may be used, for example boron, titanium, and zirconium. Suitable boron crosslinked polymers systems include by non-limiting example, guar and substituted guars crosslinked with boric acid, sodium tetraborate, and encapsulated borates; borate crosslinkers may be used with buffers and pH control agents such as sodium hydroxide, magnesium oxide, sodium sesquicarbonate, and sodium carbonate, amines (such as hydroxyalkyl amines, anilines, pyridines, pyrimidines, quinolines, and pyrrolidines), and carboxylates (such as acetates and oxalates) and with delay agents such as sorbitol, aldehydes, and sodium gluconate. Suitable zirconium crosslinked polymer systems include by non-limiting example, those crosslinked by zirconium lactates (for example sodium zirconium lactate), triethanolamines, 2,2'-iminodiethanol, and with mixtures of these ligands, including when adjusted with bicarbonate. Suitable titanates include by non-limiting example, lactates and triethanolamines, and mixtures, for example delayed with hydroxyacetic acid.

As mentioned, viscoelastic surfactant fluid systems (such as cationic, amphoteric, anionic, nonionic, mixed, and zwitterionic viscoelastic surfactant fluid systems, especially betaine zwitterionic viscoelastic surfactant fluid systems or amidoamine oxide surfactant fluid systems) may be also used. Non-limiting examples include those described in U.S. Pat. Nos. 5,551,516; 5,964,295; 5,979,555; 5,979,557; 6,140,277; 6,258,859 and 6,509,301. In general, suitable zwitterionic surfactants have the formula:

$$RCONH—(CH_2)_a(CH_2CH_2O)_m(CH_2)_b—N^+(CH_3)_2—(CH_2)_{a'}(CH_2CH_2O)_{m'}(CH_2)_{b'}COO^-$$

in which R is an alkyl group that contains from about 17 to about 23 carbon atoms which may be branched or straight chained and which may be saturated or unsaturated; a, b, a', and b' are each from 0 to 10 and m and m' are each from 0 to 13; a and b are each 1 or 2 if m is not 0 and (a+b) is from 2 to about 10 if m is 0; a' and b' are each 1 or 2 when m' is not 0 and (a'+b') is from 1 to about 5 if m is 0; (m+m') is from 0 to about 14; and $CH_2CH_2O$ may also be oriented as $OCH_2CH_2$. Preferred surfactants are betaines.

Two examples of commercially available betaine concentrates are, respectively, BET-O-30 and BET-E-40. The VES surfactant in BET-O-30 is oleylamidopropyl betaine, obtained from the supplier (Rhodia, Inc. Cranbury, N.J., U.S.A.) under the designation MIRATAINE BET-O-30; it is supplied as about 30% active surfactant and the remainder is substantially water, sodium chloride, glycerol and propane-1,2-diol. BET-E-40 is erucylamidopropyl betaine. BET surfactants, and others that are suitable, are described in U.S. Pat. No. 6,258,859. Certain co-surfactants may be useful in extending the brine tolerance, to increase the gel strength, and to reduce the shear sensitivity of VES fluids, in particular for BET-O-type surfactants. An example is sodium dodecylbenzene sulfonate (SDBS). VES's may be used with or without this type of co-surfactant, for example those having a SDBS-like structure having a saturated or unsaturated, branched or straight-chained $C_6$ to $C_{16}$ chain; further examples of this type of co-surfactant are those having a saturated or unsaturated, branched or straight-chained $C_8$ to $C_{16}$ chain. Other suitable examples of this type of co-surfactant, especially for BET-O-30, are certain chelating agents such as trisodium hydroxyethylethylenediamine triacetate.

In another embodiment, fibers can assist in transporting, suspending and placing proppant in the carrier fluid or other fracturing fluid used in the method.

Systems in which fibers and a fluid viscosified with a suitable metal-crosslinked polymer system or with a VES system are known to the skilled artisan to slurry and transport proppant as a "fiber assisted transport" system, "fiber/polymeric viscosifier" system or an "FPV" system, or "fiber/VES" system. Most commonly the fiber is mixed with a slurry of proppant in crosslinked polymer fluid in the same way and with the same equipment as is used for fibers used for sand control and for prevention of proppant flowback, for example, but not limited to, the method described in U.S. Pat. No. 5,667,012. In fracturing, for proppant or other particle transport, suspension, and placement, the fibers are normally used with particle laden fluids, not normally with pads, flushes or the like.

Any additives normally used in such well treatment fluids can be included, again provided that they are compatible with the other components and the desired results of the treatment. Such additives can include, but are not limited to breakers, anti-oxidants, crosslinkers, corrosion inhibitors, delay agents, biocides, buffers, fluid loss additives, pH control agents, solid acids, solid acid precursors, etc. The wellbores treated can be vertical, deviated or horizontal. They can be completed with casing and perforations or open hole.

Depending upon the desired area of placement of the particles, the properties of the particles and the carrier fluid may be varied. The carrier fluid may be miscible or immiscible with the pad fluid or other treatment fluids with which it is used. The carrier fluid may have the same or substantially the same density as the pad or other treating fluid. The density of the carrier fluid may also be adjusted so that its specific gravity is greater or less than that of the pad or other treating fluids. In this way, the particles can be placed along upper and lower boundaries of the fracture. Carrier fluids with higher specific gravities than the pad fluid will, assisted by the slip layer at the interface, tend to finger or slump along with the carried solids through the pad fluid due to gravity driven convection fluid flow so that the slurry is placed at the bottom of the fracture. The properties of the carrier fluid may be modified through the use of gelling agents, pH adjustors or the addition of breakers or breaker activators to provide the desired characteristics. For example, for some crosslinkers, lower pH eases carrier fluid fingering through the pad. Density can also be adjusted with weighting agents.

Similarly, carrier fluids with lower specific gravities than the pad fluid may be used. Fluids with lower densities may include light fractions of oil. Carrier fluids with lower specific gravities may also be provided by the inclusion of light-weight materials or particles within the carrier fluid. These may include such substances as light-weight ceramic materials, hollow beads, porous particles, fibers and/or foaming agents, polymer particles, e.g. polypropylene particles, which are commercially available with densities of less than 1 $g/cm^3$, etc. Due to the difference in densities, the carrier fluid containing the particles, which may include delayed water-swelling particles, non-water-swelling proppant particles, or a combination thereof, are buoyant in the pad fluid and rise to the upper portion of the fracture.

The delayed water-swelling particles and/or non-water-swelling particles (proppant) of the same or of different size distributions may be placed along the upper and lower boundaries of the fracture. Such mixture is pumped during or right after the pad treatment. The carrier fluid/particle mixture may be pumped in separate stages, with the higher specific gravity carrier fluid mixture being pumped prior to or after the lower specific gravity mixture. The particles may be placed by radial flow, facilitated by the in situ chemical formation of the slip layer at the interface that is induced in the fracture early in the treatment and carries the particles in either or both upward and downward directions. Particles are bridged in the lower and upper extremities of the fracture. The proppants or non-water-swelling particles provide dense mechanically stable barriers. Once in place, the aqueous carrier fluid or water from water producing zones can eventually cause, if used, any water-swelling material of the water-swellable particles to swell, providing further reductions in permeability and rendering additional isolation properties. Because swelling of any water-swelling particles can be delayed, preliminary swelling can be avoided to facilitate placement of the particle mixture within the extremities of the formation.

Following treatment of the formation with the artificial bridging material, further pad fluid may be pumped to provide further fracturing of the formation, with the bridging material preventing fracturing in non-producing zones. Alternatively or additionally, the treatment may continue with proppant loading in a conventional manner. The formation of a slip layer between the carrier fluid and the subsequently injected fluid is optional, but if present can also facilitate injection of the subsequent fluid by minimizing friction at the interface. The use of the slip layer and delayed water-swelling particle materials/mixtures does not generally require any changes in the main fracture treatment design and the fracturing job can usually be conducted in a normal manner.

One particular embodiment of the invention can employ a low pH carrier fluid to destabilize, at the interface, a guar based polymer or other acid sensitive gelling agent with which it comes in contact. To retain sufficient viscosity in the carrier fluid at low pH, a special gelling agent can be used. Gelling agents that can tolerate low pH include, for example, derivatized polyacrylamide polymers and other polymers known to the art. Choice and concentration of acid in the carrier fluid can be determined by the type and the loading of the gelling agent used with the main fracturing fluid in the first stage of the treatment, by the type, quantity and chemical composition of weighing agents added to the carrier fluid, as well as by the operational and economical considerations.

For example, in one particular embodiment, a concentration of hydrochloric acid in the base fluid, i.e. prior to adding low pH gelling agent, weighing agents and any other additives may vary between 1 and 20 percent by weight of the total liquid phase present in the base fluid, particularly between 2 and 15 percent by weight, and more particularly between 4 and 10 percent by weight. Acids with lower acidity constants $K_a$, such as acetic, formic, oxalic, orthophosphoric and the like, can be used in higher concentrations. For example, the base fluid can contain acetic acid in concentrations between 1 and 40 percent by weight, more particularly between 4 and 30 percent by weight, and yet more particularly between 6 and 20 percent by weight.

In another particular embodiment, the fragmentation of guar-based polymer chains, and a corresponding reduction of gel viscosity, can be based on conventional chemicals commonly used in the oilfield industry as gel breakers. These breakers typically become active either at elevated temperature or in the presence of a breaker aid. Due to cool down, downhole fluid temperatures during the initial stage of the treatment can become significantly lower than the formation temperature and only marginally higher than the surface temperature, which is lower than a preferred temperature range for most of the breakers. Hence, breaker aids can be used in one embodiment to accomplish rapid action of the breakers on the gel.

In the fluid system according to one embodiment this invention, the breaker and the breaker aid can be added to different treatment stages and mix only at the interface of the fluids in the boundary region formed as the carrier fluid penetrates the earlier-injected fluid that created the fracture in the first or pad stage of the treatment. For example, a pad stage carrying the breaker aid can be followed by the carrier fluid stage carrying the breaker, or vise versa.

One representative example of the breaker-breaker aid couple is ammonium persulfate used as a breaker and a mixture containing amines and/or aliphatic amine derivatives used as a breaker aid Ammonium persulfate is a common gel breaker effective in the temperature range of 52° to 107° C. (125° to 225° F.), which is not encountered during fluid injection in one embodiment of the invention. However, with the breaker aid, ammonium persulfate can be activated at fluid temperatures less than 52° C. (125° F.). For example, the amines and/or their derivatives can accelerate the generation of sulfate radicals, making persulfate an effective breaker when lower temperatures occur in the fracturing treatment.

Other examples of the breaker-breaker aid systems include salts of alkali metals with metal sulfides; oxyhalogen acid salts such as salts if chlorate, bromate, iodate, hypochlorite ions and the like, especially metal or preferably alkali metal salts. In the presence of acids, oxyhalogen acid salts can undergo a rapid decomposition with free radical generation in an embodiment of the invention. In a further embodiment, a catalyst such as metal particles or a transition metal compound, e.g. a Fenton reagent system, can optionally be used with an oxyhalogen acid salt.

The chemical composition of the carrier fluid should be chosen bearing in mind the compatibility of the materials, and formation properties as well as operational and economical aspects of the treatment. Selection of the gelling agent for the carrier fluid should be based on the nature of chemicals used for the placement enhancement. For example, if acid should be added to the carrier fluid, an amine polymer based gelling agent suitable for low pH media can be employed. On the other hand, for the breaker-breaker aid systems that do not involve acid as an aid, guar based polymers as well as other commonly used in the industry gelling agents can be employed for the carrier fluid.

For instance, crosslinked guar based polymer can be the main fracturing fluid used in the pad in an embodiment. The same polymer but without a crosslinker can then be used to suspend solid particles in the carrier fluid, and for the following proppant stages, crosslinked guar based polymer can be used again.

According to a further particular embodiment, the slip layer is formed by exploiting the reversibility of guar based polymer chains crosslinked with borate ions to destabilize the guar or other polysaccharide gel. In this embodiment, gel crosslinked with borate ions can be contacted at the interfacial boundary with a borate complexing agent to result in competitive reactions for borate ion, locally depleting the borate ions available for crosslinking the guar based polymer and thus impeding or reversing the crosslinking reaction and reducing polymer viscosity in the slip layer.

Borate complexing agents are described, for example, in U.S. Pat. No. 6,060,436. Such complexing agents in an embodiment can be selected from the group of natural or synthetic polyols. The term "polyol" as used herein includes organic compounds having adjacent alcohol functions. Thus, in one embodiment, polyols can include glycols, glycerin, polyvinyl alcohol, saccharides such as glucose, sorbitol, dextrose, mannose, mannitol and the like as well as other carbohydrates and polysaccharides including natural and synthetic gums, and the like. Also included in the term "polyol" are acids, acid salts, esters and amine derivatives of a polyol.

An embodiment of the borate complexing agent relates to introducing a guar or other polysaccharide based pad fluid into a wellbore followed by a carrier fluid laden with desirable barrier and/or water control material and containing a polyol or other borate complexing agent(s). After the carrier fluid stage, the treatment can be completed as a normal fracturing job as is known to those skilled in the art.

The concentration of the polyol in the carrier fluid in various embodiments can depend on the relative affinity of the particular polyol to complex borate ion and also on the nature and loading of the guar based polymer. For instance, observing crosslinking delay in borate fluids, it has been established that at equal concentrations sorbitol produces longer delays than sodium gluconate. Therefore, the former may be used at lower concentrations. Hence, each complexing agent in combination with a particular guar based gelling agent constitutes a system that can have an individually tailored concentration of complexing agent.

As one specific representative example, for instance, a fracturing fluid comprising 13.6 to 22.7 kg (30-50 lbs) of guar polymer per 3.785 $m^3$ (1000 gallons) of fracturing base fluid is mixed with borate crosslinker to yield final concentrations of boric acid between 2.27 and 4.54 kg (5-10 lbs) per 3.785 $m^3$ (1000 gallons), and of sodium hydroxide between 3.63 and 6.8 kg (8-15 lbs) per 3.785 $m^3$ (1000 gallons). Such fluid can be introduced into a wellbore first as a pad stage, and followed by a carrier fluid stage. The carrier fluid can in an embodiment contain polyacrylamide acid salt as a gelling agent, weighing or buoyancy agents, desirable barrier forming and/or water control material, and sorbitol at a concentration between 13.6 to 22.7 kg (30-50 lbs) of guar polymer per 3.785 m3 (1000 gallons).

Any conventional (non-water swellable) proppant (gravel) can be used as a bridging agent in the carrier fluid with or without water-swellable particles, or in a fracturing fluid to hold the fracture open or to form a conductive hydraulic channel following treatment. Such proppants (gravels) can be natural or synthetic (including but not limited to glass beads, ceramic beads, sand, and bauxite), coated, or contain chemicals; more than one can be used sequentially or in mixtures of different sizes or different materials. The proppant may be resin coated, preferably pre-cured resin coated. Proppants and gravels in the same or different wells or treatments can be the same material and/or the same size as one another and the term "proppant" is intended to include gravel in this discussion. In general the proppant used will have an average particle size of from about 0.15 mm to about 2.39 mm (about 8 to about 100 U.S. mesh), more particularly, but not limited to 0.25 to 0.43 mm (40/60 mesh), 0.43 to 0.84 mm (20/40 mesh), 0.84 to 1.19 mm (16/20), 0.84 to 1.68 mm (12/20 mesh) and 0.84 to 2.39 mm (8/20 mesh) sized materials. Normally the proppant will be present in the slurry in a concentration of from about 0.12 to about 0.96 kg/L, preferably about 0.12 to about 0.72 kg/L (about 1 pound proppant added per gallon of liquid (PPA) to about 8 PPA), for example from about 0.12 to about 0.54 kg/L (1 to about 6 PPA).

Particles with barrier forming or water control functions in one embodiment are those described in US Patent Application Publication No. 2008/0108524 . Briefly, delayed water-swelling materials can be prepared from particles having a core containing a water-swelling material that is surrounded by a coating that temporarily prevents contact of water with the water-swelling material. The water-swelling material may be capable of absorbing from at least about one to 600 hundred times the water-swelling material's weight of water, more particularly from about 10 to about 400 times the water-swelling material's weight of water, and still more particularly from about 40 to about 200 times the water-swelling material's weight of water.

Of particular use for the water-swelling materials are superabsorbing materials formed from polymers that are water soluble but that have been internally crosslinked into a polymer network to an extent that they are no longer water soluble, such as described in U.S. Pat. Nos. 4,548,847; 4,725,628; 6,841,229; US2002/0039869A1; and US2006/0086501A1. Non-limiting examples of superabsorbing materials include crosslinked polymers and copolymers of acrylate, acrylic acid, amide, acrylamide, saccharides, vinyl alcohol, water-absorbent cellulose, urethane, and combinations of these materials. Other water-swelling materials other than superabsorbent materials may additionally or alternatively be used, including natural water-swelling materials such as water-swelling clays, e.g. bentonite, montmorillonite, smectite, nontronite, beidellite, perlite and vermiculite clays and combinations of these. Particles of the water-swelling materials may have an unswollen particle size of from about 50 microns to about 1 mm or more.

The water-swelling materials may be used to form a composite core wherein the water-swelling materials are combined with other materials. These may include weighting agents in an amount of from 0 to about 70% by weight of the composite particle to adjust the specific gravity of the material. Examples of weighting agents may include, but are not limited to, silicates, aluminosilicates, barite, hematite, ilmenite, manganese tetraoxide, manganosite, iron, lead, aluminum and other metals. Bentonite is particularly useful as the water-swelling material when used in combination with these weighting materials. For certain applications binders may be used with the weighting agents. Examples of binder materials include thermoplastic materials, such as polystyrene, polyethylene, polymethylmethacrylate, polycarbonate, polyvinylchloride, etc. The binder materials may also include thermosetting materials, such as phenol-formaldehyde, polyester, epoxy, carbamide and other resins. Waxes may also be used as a binder material. The amount of binder used may be just enough to provide a coating so that the materials adhere together.

Other core materials in the particles may include proppants wherein the proppant constitutes an inner core and the water-swelling material forms an outer layer that surrounds the proppant. Such coated proppants have mechanical strength as well as swelling capacity. Examples of proppant materials include ceramic, glass, sand, bauxite, inorganic oxides (e.g. aluminum oxide, zirconium oxide, silicon dioxide, bauxite), etc. The coated proppant may be prepared by immersing the proppant into a solution or emulsion of the superabsorbant material and allowing the solvent to evaporate. Heating may be used to evaporate the solvents. Typical drying temperatures may be from about 110° C. to about 150° C. The solvents may be aprotic organic solvents, such as hexanes, heptanes and other saturated and unsaturated hydrocarbons. The coating thickness can be varied by adjusting the coating time and/or concentration of the dissolved superabsorbent.

The above-described method of coating proppant may have particular application to proppant materials of smaller size such as from about 0.3 mm to about 1 mm Larger proppant sizes of from 1 mm or greater may be coated with dry superabsorbants. In such instances, the proppant particles may be immersed in a binder solution and the particles, being wet, are crumbed in milled (typically less than 200 micron) superabsorbent powder, which sticks to the proppant particle surface. The particles are then allowed to dry so that the proppant particles are covered with the superabsorbent powder. For non-superabsorbing water-swelling materials, the water-swelling material coating may be applied in a fluidized bed coating procedure.

To provide delayed swelling of the water-swelling materials in the particles, the water-swelling material particle core, including composite water-swelling particle cores such as those that include weighting agents and/or proppant materials, may be provided with a coating or coatings that temporarily prevent contact of the water-swelling material with water or aqueous fluids when subjected thereto. The coating may be formed from a water degradable material that eventually degrades in the presence of water. As used herein, the expression "water degradable" or similar expression is meant to encompass the characteristic of the material to decompose, such as by dissolution, hydrolyzing, depolymerization, breaking apart of chemical bonds, and the like, upon exposure to water under selected conditions such that the material fails as a barrier layer to allow water infiltration to the water-swellable material.

In an embodiment, the water degradable materials can be solid polymer acid precursors. These are solid (at room temperature) polymers or oligomers of certain organic acids that hydrolyze or depolymerize under known and controllable conditions of temperature, time and pH to form their monomeric organic acids. One example is the solid cyclic dimer of lactic acid (known as "lactide"), which has a melting point of 95° C. to 125° C., depending upon the optical activity. Another is the polymer of lactic acid, sometimes called a polylactic acid (PLA), or a polylactate, or a polylactide. Another example is the polymer of glycolic acid (hydroxyacetic acid), also known as polyglycolic acid (PGA), or polyglycolide. Another example is the solid cyclic dimer of glycolic acid, known as glycolide, which has a melting point of about 86° C. Other materials suitable as solid acid-precursors are all those polymers of glycolic acid with itself or other hydroxy acids, such as are described in U.S. Pat. Nos. 4,848,467; 4,957,165; and 4,986,355. Many of these polymers are essentially linear, but may also include some cyclic structures, including cyclic dimers, and can be homopolymers, copolymers, and block copolymers.

Other examples of solid polymer acid precursors useful in the particles can include polyesters of: hydroxycarboxylic acids such as the polymers of hydroxyvaleric acid (polyhydroxyvalerate), hydroxybutyric acid (polyhydroxybutyrate) and their copolymers with other hydroxycarboxylic acids. Polyesters resulting from the ring opening polymerization of lactones such as epsilon caprolactone (polyepsiloncaprolactone) or copolymers of hydroxyacids and lactones can also be used; and polyesters obtained by esterification of other hydroxyl containing acid containing monomers such as hydroxyaminoacids, e.g. L-aminoacids including L-serine, L-threonine, and L-tyrosine, by reaction of their alcohol and their carboxylic acid group.

The rates of the hydrolysis reactions and/or dissolution of all these materials in the particles are governed by the molecular weight, the crystallinity (the ratio of crystalline to amorphous material), the physical form (size and shape of the solid), and in the case of polylactide, the amounts of the two optical isomers. Some of the polymers dissolve very slowly in water before they hydrolyze.

To coat the particle core containing the water-swelling material, the solid polymer acid precursor may be physically dissolved in an organic solvent such as alcohols, ketones, esters, ethers, and combinations of these, with representative examples in an embodiment including acetone, ethylacetate, butylacetate, toluene, dibasic esters, light petroleum distillates, ethanol, isopropanol, acetonitrile and combinations of these. By immersing the particle core containing the water-swelling material in a solution of the dissolved solid polymer acid precursor and allowing the solvent to evaporate, a coating of the solid polymer acid precursor can be formed that surrounds the particle core. The thickness of the coating can be varied by adjusting the coating agent concentration in the immersion solution. The coating may also be applied in a fluidized bed wherein the coating thickness is varied by adjusting exposure time and concentration.

Additionally, several layers of the solid polymer acid precursor coating may be applied by this technique. This may be accomplished by providing a protective layer to a previously applied coating to prevent the coating's dissolution during recurring immersion of the particle into solution of the solid polymer acid precursor. The protective material may be an oil, plastificator or viscous solvent that does not dissolve the coating material or dissolves it very slowly. Examples of such materials may include glycerin, ethyleneglycol, organic oils, silicones, esters of phthalic acid and combinations of these. To protect the previously applied coating it is enough to treat the particles with the protective material between the repeating of the immersion coating of the particle as previously described. This may be carried out any number of times to provide the desired thickness of the coating.

The degree of delay in swelling provided by the coating for the particles can be determined by performing simple tests using water or fluids under conditions that simulate those that are expected to be encountered in the particular application or treatment for which the particles are to be used. The delayed water-swelling particles can be tailored with a sufficient coating or treatment to provide the desired degree of delay in swelling based upon these tests.

The particles can also include an encapsulating layer, e.g. a material that is non-water-degradable or may have only limited degradability in water so that the encapsulating coating must be mechanically broken or removed or which may be degradable primarily in oil (non-water) to allow contact of the water-swelling material with water, preferably other than mineral oxide (e.g. silica, aluminum) materials or resins or other materials that degrade primarily in response to downhole temperature conditions. These protective materials may be broken upon fracture closing or other mechanisms that cause breakage of the coating. Examples of suitable encapsulating materials may include natural gums (e.g. gum acacia, gum arabic, locust bean gum); polysaccharides such as modified starches (e.g. starch ethers and esters, and enzyme-treated starches) or cellulose compounds (e.g. hydroxymethylcellulose or carboxymethylcellulose); polysaccharides; proteins, such as casein, gelatin, soy protein and gluten, and synthetic film-forming agents, such as polyvinyl alcohol, polyvinyl pyrrolidone, carboxylated styrene, non-water absorbent polyvinyl alcohol, polyvinyl pyrrolidone, polyvinylidene chloride, and mixtures of these. These and other suitable encapsulating materials may include those that are described in U.S. Pat. Nos. 3,952,741; 3,983,254; 4,506,734; 4,658,861; 4,670,166; 4,713,251; 4,741,401; 4,770,796; 4,772,477; 4,933,190; 4,978,537; 5,110,486; 5,164,099; 5,373,901; 5,505,740; 5,716,923; 5,910,322; and 5,948,735.

In another embodiment, delayed water-swelling particles can be formed by restricting the mobility of the polymer chains at the surface of the superabsorbing particles, e.g., by surface crosslinking the polymer particles with a crosslinking agent such as metal salts or complexes, particularly those that are transition metal based; and/or by refluxing the superabsorbing particle in an alcohol (such as isopropanol) solution of a transition metal complex; in particular complexes of zirconium and titanium. The crosslinking surface treatment delays water penetration into the body of the water-swelling particle.

In certain applications, the delayed water-swelling particles may be provided by methods other than through the use of surface coatings or treatment. These may include the use of a non-aqueous carrier fluid or emulsions wherein the water-swelling material is carried in the oil phase of an oil and water emulsion, which may be an oil-in-water or water-in-oil emulsion. Additionally, the use of aqueous metal salt solutions, such as halogenides of alkali and alkali-earth metals (e.g. sodium chloride) with the superabsorbing materials is known to delay the swelling of the superabsorbing material.

Combinations of the above-described methods for delaying swelling of the water-swelling material may be used. For example, superabsorbing materials that have undergone surface crosslinking may be coated with a coating or coatings of water degradable materials or non-water-degradable encapsulating materials or both. Water-swelling materials may be coated with coatings of water degradable materials and non-water-degradable encapsulating materials. These materials may be used in non-aqueous carriers or in the oil phase of an oil and water emulsion.

The above-described delayed water-swelling particles may be used alone or in combination with other materials for various applications. The delayed water-swelling particles may be of various shapes and sizes, which may be dependent upon the particular application for which they are used. The delayed water-swelling particles may be used in combination with other particles. These may include inert, non-water-swelling particles that may be non-malleable particles such as ceramic, glass, sand, bauxite, inorganic oxides, e.g. aluminum oxide, zirconium oxide, silicon dioxide, bauxite, etc.

In particular applications, the delayed water-swelling particles may be used in combination with non-water-swelling particles of different size distributions. The use of such particles of different size distributions to reduce formation permeability is described in U.S. Pat. No. 7,004,255. In an embodiment, the different sized non-water-swelling particles may have a particle size of from about 0.035 mm to about 2.35 mm or more. The non-water-swelling particles may have a particle size distribution wherein the mean particle size of the larger non-water-swelling particles is at least about 1.5 times greater than that of the smaller non-water-swelling particles. The non-water-swelling particles of different sizes in an embodiment may include a combination of at least two or more of: relatively coarse particles having a particle size of from about 0.2 mm to about 2.35 mm; relatively medium particles having a particle size of from about 0.1 mm to less than about 0 2 mm; and relatively fine particles having a particle size of less than about 0.1 mm The delayed water-swelling particles may be used in combination with the non-water-swelling particles in an amount of from about 0.5% to about 50% or more by total weight of particles. The delayed water-swelling particles may be pre-mixed with the non-water-swelling particles or may be added separately. In an embodiment, a mixture of non-water-swelling particles of from about 30 to about 95% by total weight of non-water-swelling particles of the coarse particles, 0 to about 30% by total weight of non-water-swelling particles of the medium particles, and 0 to about 20% by total weight of non-water-swelling particles of the fine particles may be suitable in many applications. These guidelines are generally accurate for the normal situation in which the particles are not perfect spheres, are not uniform in size, and are not perfectly packed.

In certain applications utilizing encapsulated water-swelling materials, the particle size of the unswollen water-swelling particles may be the same or within the same range as the largest non-water-swelling particles. This facilitates the most efficient mechanical release, as smaller water-swelling particles may tend to pack in the interstitial space between the large non-water-swelling particles so that the encapsulating layer is never broken. In other applications, such as in drilling applications, where an encapsulating layer is not used, the water-swelling particles may be smaller than the largest non-water swelling materials.

In hydraulic fracturing of subterranean formations of oil or gas wells, the delayed water-swelling particles may be used alone or in combination with non-water-swelling particles to treat the upper and/or lower boundaries of the fracture where insufficient stress barriers may result in vertical fracture growth or where the fracture grows into adjacent water or undesirable gas bearing zones. The non-water-swelling proppant particles and water-swelling particles create mechanically sound barriers that are able to isolate upper and lower zones from pressure developed in the fracture during treatment, with the water-swelling materials eventually sealing the pore spaces between the non-water-swelling particles, thus creating an impermeable artificial barrier.

To create artificial barriers that prevent fracture growth into undesirable areas, the particles may be added to the fracturing fluid and pumped into the fracture during the hydraulic fracturing treatment. In an embodiment, the mixture may be pumped at the beginning of the treatment after the pad stage and prior to the main proppant stages. The particles are added to a carrier fluid to form a slurry. The particles may have a density that is the same, higher or lower than that of the carrier fluid. Because delayed water-swelling particles can be used, aqueous or water-based fluids may be used as the carrier fluid.

The carrier fluid and/or other fracturing fluid can, if desired, also include fibers. These may be formed in embodiments from carbon- or silicon-based polymers. The fibers facilitate suspending of the particles in the carrier fluid and have a negligible effect on the proppant pack permeability after the fracture closes. The concentration and nature of the fibers may be tailored to both assist particle suspension and to form a less permeable barrier along the lower and/or upper boundary of the fracture.

EXAMPLES

Figure 3:
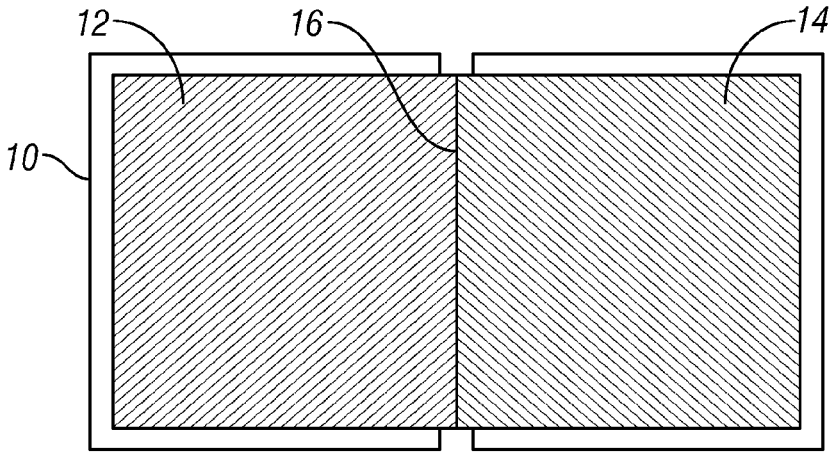
FIG. 3 is a schematic illustration of a gravitational slumping slot used in the examples to qualitatively evaluate the ability of a carrier fluid to penetrate a pad fluid, shown at the beginning of an experiment just after removal of the divider.
Figure 4:
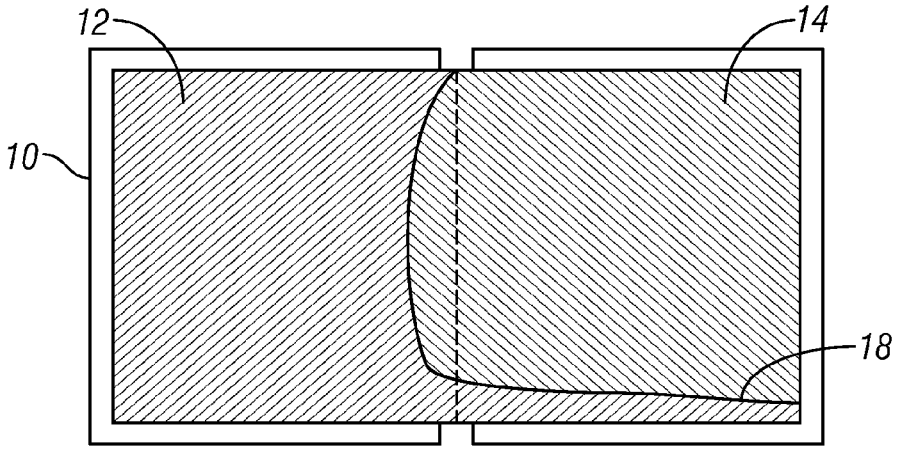
FIG. 4 is a schematic illustration of the gravitational slumping slot of FIG. 3, shown at an early stage of bank development due to slumping.
Figure 5:
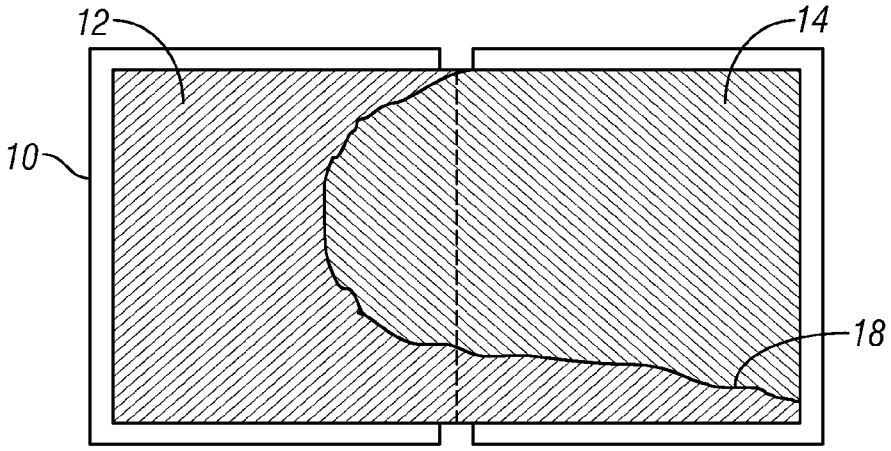
FIG. 5 is a schematic illustration of the gravitational slumping slot of FIGS. 3 and 4, shown at a later stage of bank development.

Experimental setup: experiments were performed in a gravitational slumping slot to draw a qualitative comparison between the ability of carrier fluids to penetrate standard fracturing fluids. A PLEXIGLASS slot 10 with the dimensions of 45.7×96.5×0.76 cm (18×38×0.3 inches) with a longer bottom side was divided into two tightly sealed compartments 12,14 of equal volume. In a typical experiment, compartment 12 was filled with the examined carrier fluid while compartment 14 was filled with a standard fracturing gel as shown schematically in FIG. 3. The standard fracturing gel was colored with a neutral die for better visual observation. The divider 16 (FIG. 3) was removed and the fluids were allowed to interact as shown in FIGS. 4 and 5. Penetration rate of the carrier fluid was measured by the height of its bank 18 built in the opposite compartment. It should be noted that while the carrier fluid composition and properties were varied, the fracturing gel used in all experiments had identical formulation and was prepared following once established procedure.

Fluids: the fracturing gel used in all experiments consisted of guar polymer dissolved in water and crosslinked with borate salt. The polymer loading and crosslinker formulation were identical in all experiments, while the base fluid composition could vary. Specifically, breaker or breaker aid were added to the base fluid as manipulated variables.

One type of the carrier fluid tested in these experiments employed linear amine polymer as a gelling agent and contained inorganic or organic acids, and solid particles, such as fine barite or sand, as a weighing agent. The other carrier fluid type employed linear guar polymer as a gelling agent and contained breakers or breaker aids and solid weighing agents.

Example 1

In this experiment, the base fluid for the fracturing gel was 2 wt % KCl solution that contained phenolphthalein pH indicator. Gelling agent (guar polymer) was slowly added to the base fluid under stiffing to yield the final concentration of 2.64 g/L (22 lbs/1000 gal). The polymer was allowed to hydrate for 30 min and then crosslinker solution was added to the mixture. The gel instantly turned deep purple color and gained viscosity in about 5 minutes.

The base fluid for the carrier was also 2 wt % KCl solution. The amine polymer based gelling agent in a form of concentrated solution was slowly added to attain the final concentration of 20 mL/L. The mixture was stirred for 30 minutes to allow full hydration of the polymer and then barite was slowly added; the final barite/clean fluid ratio was 1.06 kg/1 L (8.8 PPA in oilfield units); the final density of the slurry was 1.78 g/mL.

The gel and the carrier fluid were loaded in the slot, the slot was secured in a vertical position, the divider was removed and the carrier fluid bank growth in the gel compartment of the slot was timed. The experiment was stopped when bank development ceased.

The experimental setup and the fluids formulation in the second experiment in this example were identical to the first one, but included a single variation in the formulation of the carrier fluid: the base fluid for the carrier contained 4 wt % of hydrochloric acid (HCl). Slumping rates of the two carrier fluids expressed as the carrier fluid bank height vs. time are compared in FIG. 6. The same height (15-20 cm) of the carrier fluid tongue penetrating into the light fluid (pad) is achieved by 4-5 times faster due to a low viscosity slip layer induced by acid at the boundary between the two different fluids. The bulk of the two different fluids retained their viscosities away from the boundary layer. In this qualitative experiment, the accelerating effect of the slippery interface is essential for process performance.

Example 2

The fracturing fluid in this experiment was identical to the one described in the EXAMPLE 1 and was prepared following the same procedures. The base fluid for the carrier was 2 wt % KCl solution. The gelling agent in the carrier fluid was guar polymer in a form of powder which was slowly added to the base fluid to yield the final concentration 3.6 g/L (30 lbs/1000 gal). The mixture was stirred for 30 minutes to allow full hydration of the polymer and then fine mesh sand with a mean particle size of 63 μm was added to the fluid to produce the final sand/clean fluid ratio of 1.44 kg/L (12 PPA in oilfield units). The slurry density was 1.48 g/mL and the viscosity measured 57 mPa-s at 170 $sec^{-1}$ and 37 mPa-s at 510 $sec^{-1}$.

The fluids were loaded in the plastic slot and the test was performed as described in the Experimental Setup section. The carrier fluid bank growth curve obtained in this measurement was assumed as a reference plot for this carrier fluid-fracturing fluid system.

The second experiment in this series was aimed to test a breaker-breaker aid couple on the slumping rate of the carrier fluid. In the carrier fluid used in the second experiment, the gelling agent (guar) concentration in the carrier fluid was set at 7.2 g/L (60 lbs/1000 gal) in order to offset the viscosity loss due to the ammonium persulfate breaker added to the base fluid at 3.6 g/L (30 lbs/1000 gal). The weighing agent and its loading were the same as in the previous experiment: 1.44 kg/L (12 PPA in oilfield units) of 63 μm sand. The slurry density was 1.52 g/mL; the viscosity measured 52 mPa-s at 170 $sec^{-1}$ and 34 mPa-s at 510 $sec^{-1}$.

Fracturing fluid: The only difference in the fracturing fluid formulation was adding 20 mL/L (20 gallons per thousand gallons (gpt)) of triethanolamine solution immediately before crosslinking the polymer, to function as a breaker aid.

Figure 6:
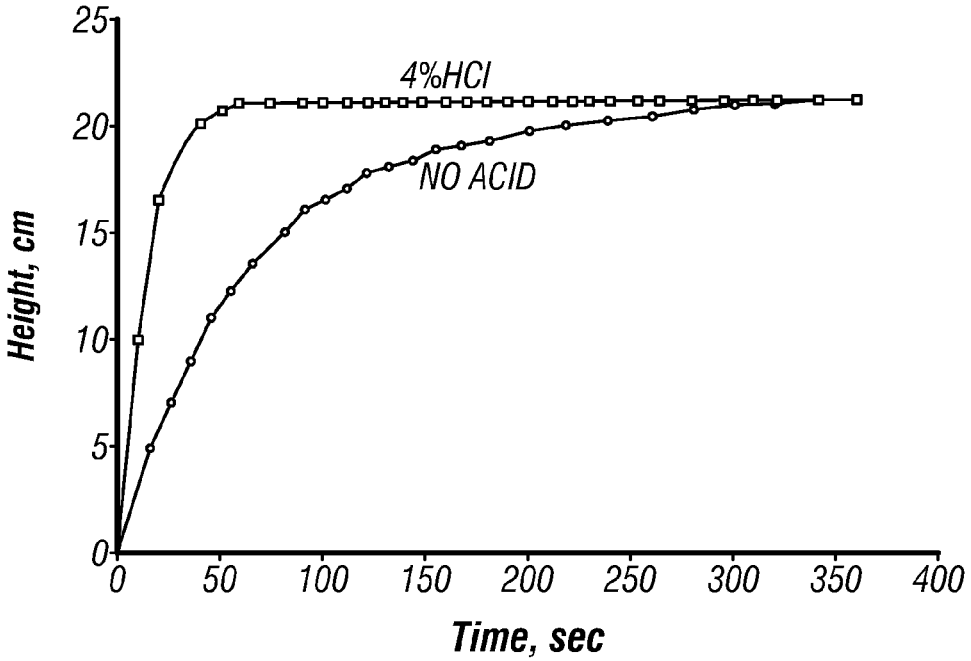
FIG. 6 plots bank height of a carrier fluid against a fracturing fluid containing crosslinked guar gel, comparing a carrier fluid with HCl as a breaker according to an embodiment of the invention to the same carrier fluid without breaker.
Figure 7:
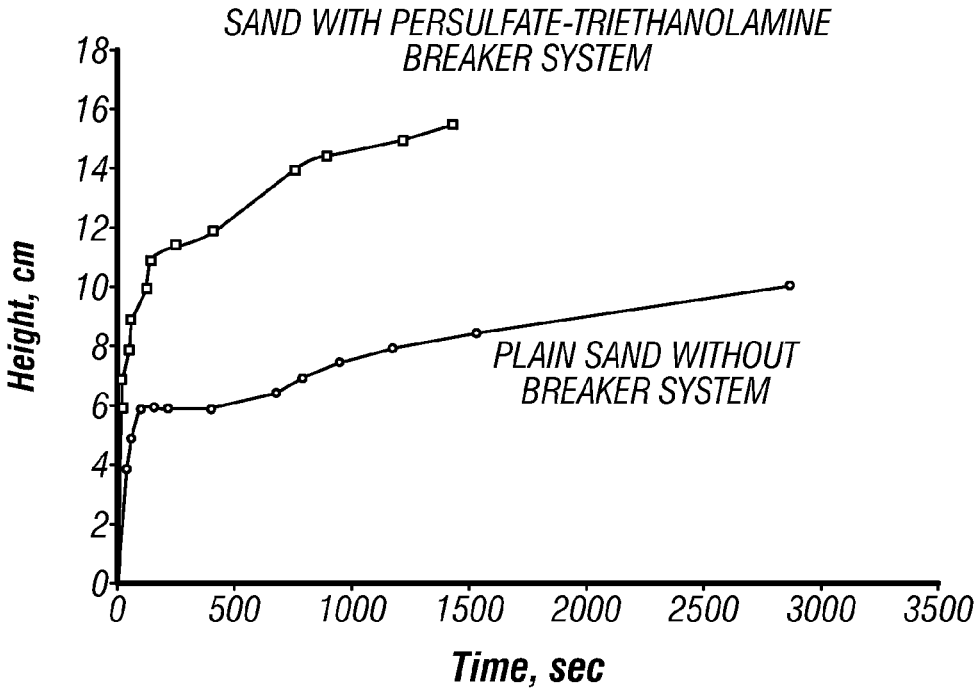
FIG. 7 plots bank height of a carrier fluid against a fracturing fluid containing crosslinked guar gel and sand, comparing a carrier fluid-fracturing fluid system with ammonium persulfate in the carrier and triethanolamine in the fracturing fluid as a breaker-breaker aid pair according to an embodiment of the invention to the same system without the breaker-breaker aid pair.

Slumping curves of the plain fluids and the fluids incorporating breaker and breaker aid are shown in FIG. 6, and clearly indicate the acceleration of slumping by several fold in the latter system.

It should be understood that throughout this specification, when a concentration or amount range is described as being useful, or suitable, or the like, it is intended that any and every concentration or amount within the range, including the end points, is to be considered as having been stated. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

For jurisdictions where incorporation by reference is permitted, the disclosures of each of the patents, applications and publications referred to herein above are incorporated herein by reference in their entireties to the full extent not inconsistent with the present invention.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method of treating a formation penetrated by a wellbore comprising:

introducing a first fluid comprising a first gelling agent into the formation, wherein the first fluid has a viscosity of at least 35 mPa-s;

introducing a second fluid comprising a second gelling agent into the formation in contact with the first fluid at an interface between the first and second fluids, wherein the first and second gelling agents can be the same or different, and the second fluid has a viscosity of at least 35 mPa-s; and forming a slip layer having a viscosity of less than 15 mPa-s at the interface between the first and second fluids to facilitate penetration of the second fluid through the first fluid, wherein the slip layer is formed in situ by the reaction of at least one reactant from the first fluid and at least one reactant from the second fluid.

2. The method of claim 1 wherein the first fluid introduction comprises injection of a pad fluid in a fracturing treatment.

3. The method of claim 2 wherein the second fluid introduction comprises injection of a carrier fluid comprising a solids-laden slurry in the fracturing treatment.

4. The method of claim 3 wherein the slurry comprises particles selected from delayed water-swelling particles, bridging materials, leak-off control materials and combinations thereof.

5. The method of claim 4 wherein the slurry comprises a water absorbing composition comprising a particle having a core of a water-swelling material and a coating substantially surrounding the core that temporarily prevents contact of water with the water-swelling material, the coating being formed from at least one of (1) a layer or layers of water degradable material and (2) a non-water-degradable, non-water absorbent layer or layers of encapsulating material.

6. The method of claim 3 the pad and carrier gelling agents are selected from linear polymers, crosslinked polymers and viscoelastic surfactant systems.

7. The method of claim 6 wherein the reactants comprise a viscosity breaker for at least one of the pad or carrier gelling agents in at least one of the pad or carrier fluids.

8. The method of claim 7 wherein at least one of the pad or carrier gelling agents is selected from linear and crosslinked polysaccharides and the breaker is selected from mineral and organic acids and their precursors.

9. The method of claim 8 wherein a polysaccharide gelling agent is present in the pad fluid and the breaker is present in the carrier fluid.

10. The method of claim 9 wherein the carrier fluid comprises an acidic pH and a carrier gelling agent comprising amine polymer hydrated at the pH of the carrier fluid.

11. The method of claim 10 wherein the pad stage further comprises an activatable breaker selected from breakers activated by acidic conditions.

12. The method of claim 11 wherein the activatable breaker comprises an oxyhalogen acid salt.

13. The method of claim 7 wherein the pad and carrier fluids each comprise a gelling agent selected from linear and crosslinked polysaccharides wherein the pad fluid gelling agent and the carrier fluid gelling agent can be the same or different, wherein the viscosity breaker is present in one of the pad and carrier fluids, and a breaker aid is present in the other of the pad and the carrier fluids.

14. The method of claim 13 wherein the breaker comprises an ammonium or alkali metal salt of peroxydisulfuric acid.

15. The method of claim 14 wherein the breaker aid is selected from amines, aliphatic amine derivatives and mixtures thereof.

16. The method of claim 3 wherein at least one of the pad or carrier gelling agents comprises borate crosslinked polysaccharide and the other of the pad or carrier fluids comprises a hydrated amine polymer.

17. The method of claim 16 wherein the hydrated amine polymer-gelled fluid comprises a borate-ion-complexing agent, wherein the slip layer is created by depleting borate availability at a boundary of the second fluid.

18. The method of claim 17 wherein the borate-ion-complexing agent comprises a polyol.

19. The method of any one of claim 1 wherein the first and second fluids have a viscosity during the introductions of at least 50 mPa-s, and the slip layer has a viscosity less than 10 mPa-s.

20. The method of claim 19 wherein the first and second fluids have different specific gravities.

21. A method of fracturing a formation penetrated by a wellbore comprising:

injecting a pad fluid comprising a pad gelling agent into the formation, wherein the pad fluid has a viscosity of at least 35 mPa-s;

injecting a carrier fluid comprising a proppant-laden slurry comprising a carrier gelling agent into the formation in contact with the pad fluid at an interface between the pad and carrier fluids, wherein the pad and carrier gelling agents can be the same or different and are selected from linear polymers, crosslinked polymers and viscoelastic surfactant systems, and the carrier fluid has a viscosity of at least 35 mPa-s; and forming a slip layer having a viscosity of less than 15 mPa-s at the interface between the pad and carrier fluids to facilitate penetration of the carrier fluid through the pad fluid, wherein the slip layer is formed in situ by the reaction of at least one reactant from the pad fluid and at least one reactant from the carrier fluid;

wherein at least one of the pad and carrier fluids comprise a viscosity breaker for at least one of the pad or carrier gelling agents.

22. The method of claim 21 wherein the pad fluid is heavier than the carrier fluid and the proppant is buoyant.

23. The method of claim 21 wherein the pad fluid is lighter than the carrier fluid and the proppant is negatively buoyant.

24. The method of claim 21 wherein the pad and carrier fluids have a viscosity of at least 50 mPa-s, and the slip layer has a viscosity less than 10 mPa-s.

* * * * *